US006385804B1

(12) United States Patent
Barber et al.

(10) Patent No.: US 6,385,804 B1
(45) Date of Patent: May 14, 2002

(54) PRESSURE CONTROL LED PAD

(75) Inventors: David Gillman Barber, Gwent; David Mark Hampson, Cardiff, both of (GB)

(73) Assignee: Huntleigh Technology, PLC (GB)

( * ) Notice: Subject to any disclaimer, the term of this patent is extended or adjusted under 35 U.S.C. 154(b) by 0 days.

(21) Appl. No.: 09/509,720

(22) PCT Filed: Jul. 29, 1999

(86) PCT No.: PCT/GB99/02502

§ 371 Date: Jun. 30, 2000

§ 102(e) Date: Jun. 30, 2000

(87) PCT Pub. No.: WO00/06001

PCT Pub. Date: Feb. 10, 2000

(30) Foreign Application Priority Data

Jul. 30, 1998 (GB) ..... 9816473

(51) Int. Cl.[7] ..... A47C 27/08

(52) U.S. Cl. ..... 5/708; 5/654; 137/614.2

(58) Field of Search ..... 5/708, 654, 706, 5/655.3, 709; 137/614.2

(56) References Cited

U.S. PATENT DOCUMENTS

| | | | | | |
|---|---|---|---|---|---|
| 5,074,765 | A | | 12/1991 | Pekar | |
| 5,406,661 | A | * | 4/1995 | Pekar | 5/708 |
| 5,634,224 | A | * | 6/1997 | Gates | 5/154 |
| 5,676,639 | A | * | 10/1997 | Schild | 601/151 |
| 6,209,160 | B1 | * | 4/2001 | Harris | 5/708 |

FOREIGN PATENT DOCUMENTS

GB 2275986 9/1994

* cited by examiner

*Primary Examiner*—Alexander Grosz
(74) *Attorney, Agent, or Firm*—Brown Raysman Millstein Felder & Steiner LLP

(57) ABSTRACT

An inflatable seating pad (10) consists of a hand operated pump (12) integrated within the top surface to inflate the pad with air. The pad (10) has a shut-off connector (6) at one corner which locates and is connected to a pressure relief valve (8). In use, the pad (10) is inflated by pushing upon the hand operated pump (12) to over inflate the pad. The shut-off connector (6) maintains the pressure in the pad (10). To set the pressure to a desired pressure the user actuates the pressure relief valve (pre-set to optimum pressure) to operate the shut-off connector (6) to allow air to exhaust through the pressure relief valve.

7 Claims, 2 Drawing Sheets

PRESSURE CONTROL LED PAD

BACKGROUND OF THE INVENTION

The present invention relates to a body support system, in particular to an inflatable support pad that can be set to a desired pressure or firmness.

Such supports, for example, inflatable cushions are well known and are normally set to a desired pressure with the person supported thereon, by either connecting an external pump and gauge to an inflation port on the cushion and sealing the port after inflation or using an external pump with a relief valve set to the required pressure.

The above methods have the disadvantage of having to use a meter gauge or pressure relief valve requiring operator skill to set the desired pressure. Also, the body support systems using such pumps and gauges or relief valves would be very inconvenient and time consuming to set or change to a desired firmness in situ with the person supported thereon.

SUMMARY OF THE INVENTION

The present invention provides a pressure controlled inflatable pad apparatus for supporting a body comprising an inflatable pad, a source of fluid to inflate the pad, a shut-off connector connecting the pad to exhaust through a pressure relief valve, the pressure relief valve operating the shut-off connector to connect the pad to exhaust if the pad is over inflated until a predetermined pressure within the pad is reached.

The pressure relief valve is connected to the shut-off connector on the inflatable pad and operates the shut-off connector by means of positive engagement. Therefore, when not actuated the pressure relief valve remains attached and integral with the inflatable pad making it readily available for the user. Further, since the pressure relief valve only becomes part of the fluid circuit when actuated, the problems associated with such valves when continuously connected are avoided. Thus, there is no gradual leakage in the system due to imperfections in the seal surfaces of such valves. Also, user movement on the pad causing transient high pressures does not result in venting off by the pressure relief valve to a subsequent lower pressure than desired.

The valve is simple to operate when compared to existing systems that require external intervention to remove the valve or the pump, out of circuit.

Preferably, the fluid source is a hand operated pump integrated within the inflatable pad, which makes the inflatable pad a complete single unit body support system without requiring the external pumps with gauges/valves of existing systems. The system is thus a simple design providing a cost advantage over the existing systems, and moreover the carer or user has only one item to carry rather than ensure that the inflatable pad as well as the associated pump/gauges/valves are available.

According to another aspect of the invention, there is provided a pressure controlled inflatable pad apparatus for supporting a body comprising an inflatable seating pad, a hand operated pump located within the pad to inflate the pad, a shut-off connector connecting the pad to exhaust through a pressure relief valve, the pressure relief valve operating the shut-off connector to connect the pad to exhaust if the pad is over inflated until a predetermined pressure within the pad is reached.

According to a further aspect of the present invention there is provided a method of supporting a person on a uniform pressure support surface comprising the steps of inflating an inflatable pad by means of an integrated hand pump to an over inflate condition, inserting the pad under the person supported thereon, actuating a pressure relief valve connected to a shut-off connector attached to the pad for a pre-determined time whereby the shut-off connector allows air to vent from the pad through the pressure relief valve which is set to a pre-determined pressure.

BRIEF DESCRIPTION OF THE DRAWING

A preferred embodiment of the present invention will now be described with reference to the accompanying drawings in which.

DETAILED DESCRIPTION OF THE PREFERRED EMBODIMENTS

Figure 1:
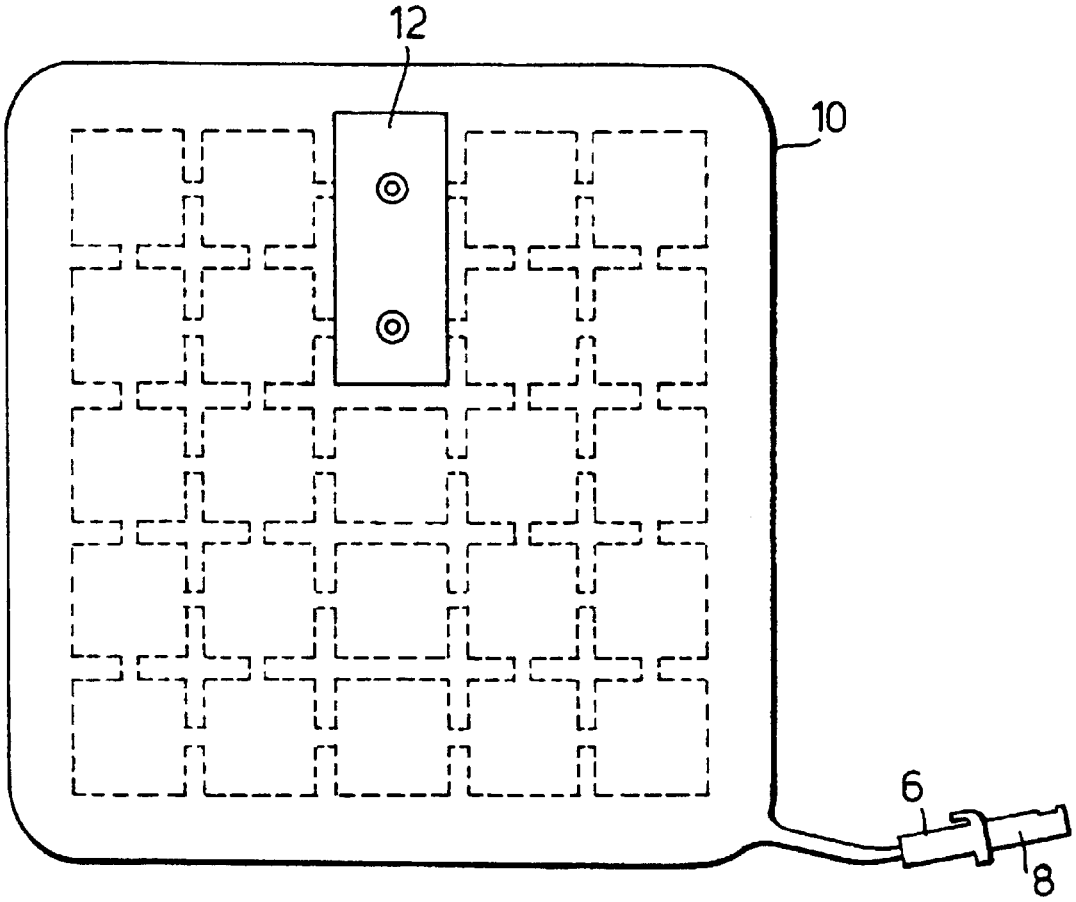
FIG. 1 is a schematic view of an inflatable seating pad according to the present invention.

Referring first to FIG. 1, an inflatable seating pad 10 consists of a hand operated pump 12 integrated within the top surface to inflate the pad with air. The pad 10 has a shut-off connector 6 at one corner which locates and is connected to a pressure relief valve 8.

Figure 2:
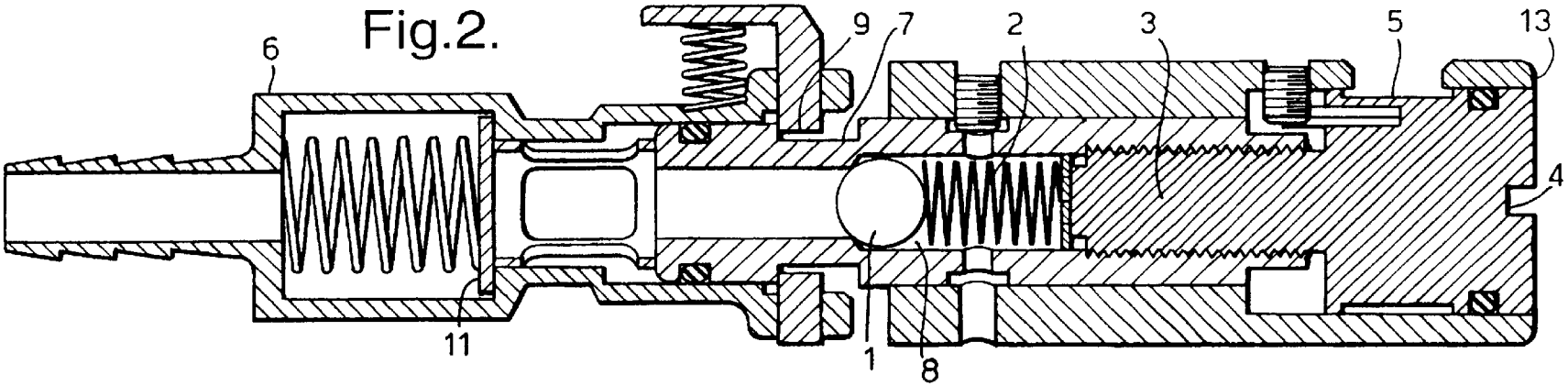
FIG. 2 is a cross-sectional view of the pressure relief valve and the shut-off connector according to the present invention.

As shown in FIG. 2, the shut-off connector 6 consists of a shut-off valve 11 and the pressure relief valve 8 consists of a spring loaded valve closure, in this case a ball 1 resting on a circular seating. Air will flow out of the valve 8 when the air pressure in the pad 10 is greater than the sealing pressure derived from the pre-loaded spring 2.

The relief pressure can be varied by adjusting the pre-load on spring 2.The pre-load is adjusted by a screw threaded plunger 3 acting on the spring 2. The shaft of the plunger 3 includes a coin slot 4 to adjust the spring pre-load and hence the pre-set pressure for the pad 10.

The coin slot 4 allows for the plunger to be rotated by the user or carer when needed to change the pre-set pressure, but cannot be inadvertently rotated by mistake.

The screw plunger 3 may have a graduated scale 5 around its circumference, to give an indication of the set pressure.

The pressure relief valve assembly 8 is adapted to clip into the connection profile 9 of the shut-off connector 6 on the pad 10.

The pressure relief valve has a locking groove 7 to locate and secure the valve onto the connection profile 9 of the shut-off connector 6. The locking groove 7 is of an increased length than the corresponding connection profile 9 so that upon insertion, the pressure relief valve 8 is held in place within the shut-off connector 6 but does not engage with the shut-off valve 11.

Figure 3:
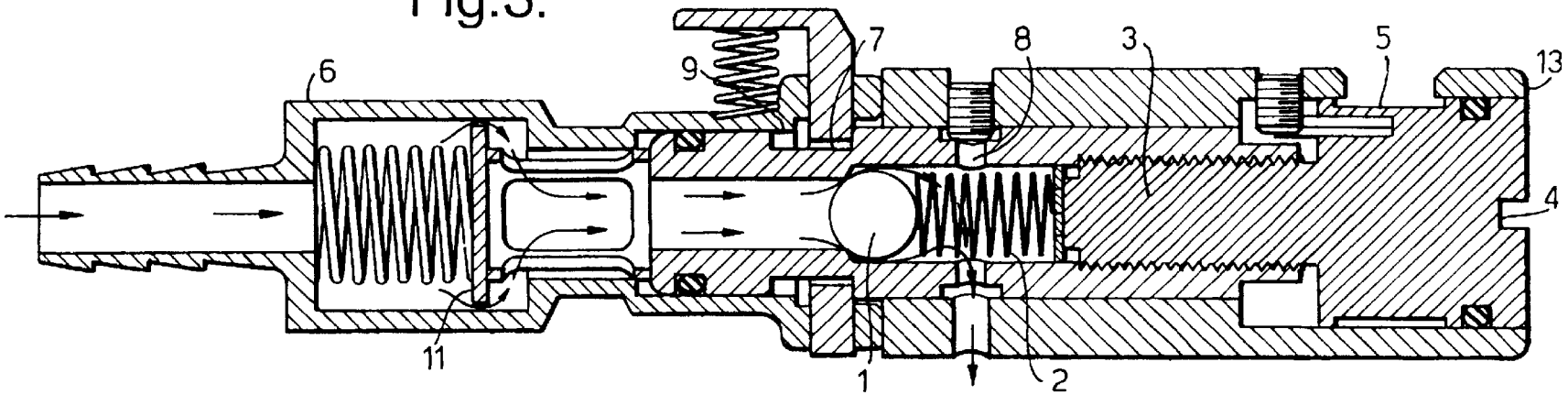
FIG. 3 is a cross-sectional view of the pressure relief valve actuating the shut-off connector.

In use, the pad 10 is inflated by pushing upon the hand operated pump 12 several times, say ten, to over inflate the pad 10. The shut-off valve 11 within connector 6 maintains the pressure within the pad. To set the pressure to a predetermined optimum pressure for the user, the user when supported by the pad manually depresses the protruding end 13 of the pressure relief valve 8 which acts on the shut-off valve 11 to allow air to flow through the pressure relief valve to exhaust (see FIG. 3).

When released, the spring in the shut-off valve 11 will seal off the connector 6, preventing any further air flow from the pad 10 through to the pressure relief valve 8. The pressure relief valve 8 may be thus activated by the user for a pre-determined time, typically ten seconds, to achieve the desired set pressure which is then maintained by the valve 11 in shut-off connector 6. The pressure relief valve 8 may be activated as and when required to re-set the pressure within the pad.

Although the preferred embodiment, as outlined above, refers to a seating pad the same principle according to the present invention may be used for similar body supports such as inflatable pads or mattresses for lying on, or other types of inflatable body supports such as inflatable compression garments, back or neck supports or the like within the scope of the present invention.

What is claimed is:

1. A pressure controlled inflatable pad apparatus for supporting a body comprising an inflatable pad, a source of fluid to inflate the pad, a shut-off connector connecting the pad to exhaust through a pressure relief valve, the pressure relief valve operating the shut-off connector to connect the pad to exhaust if the pad is over inflated until a predetermined pressure within the pad is reached.

2. A pressure controlled inflatable pad apparatus as claimed in claim 1, wherein the pressure relief valve is connected to the shut-off connector on the inflatable pad and operates the shut-off connector by means of positive engagement.

3. A pressure controlled inflatable pad apparatus as claimed in claim 1, wherein the fluid source is a hand operated pump integrated within the inflatable pad.

4. A pressure controlled inflatable pad apparatus for supporting a body comprising an inflatable seating pad, a hand operated pump located within the pad to inflate the pad, a shut-off connector connecting the pad to exhaust through a pressure relief valve, the pressure relief valve operating the shut-off connector to connect the pad to exhaust if the pad is over inflated until a predetermined pressure within the pad is reached.

5. A pressure controlled inflatable pad apparatus as claimed in claim 4, wherein the pressure relief valve is connected to the shut-off connector on the inflatable pad and operates the shut-off connector by means of positive engagement.

6. A method of supporting a person on a uniform pressure support surface comprising the steps of inflating an inflatable pad by means of an integrated hand pump to an over inflated condition, inserting the pad under the person supported thereon, actuating a pressure relief valve connected to a shut-off connector attached to the pad for a pre-determined time whereby the shut-off connector allows air to vent from the pad through the pressure relief valve which is set to a pre-determined pressure.

7. A method of supporting a person on a uniform pressure support surface comprising the steps of inflating an inflatable pad by means of an integrated hand pump to an over inflated condition, inserting the pad under the person supported thereon, and actuating a pressure relief valve connected to a shut-off connector attached to the pad, whereby the shut-off connector allows air to vent from the pad through the pressure relief valve which is set to a predetermined pressure.

* * * * *

UNITED STATES PATENT AND TRADEMARK OFFICE

CERTIFICATE OF CORRECTION

PATENT NO. : 6,385,804 B1 
DATED : May 14, 2002
INVENTOR(S) : Barber et al.

It is certified that error appears in the above-identified patent and that said Letters Patent is hereby corrected as shown below:

Title page,
Item [54], delete "CONTROL LED" and insert -- CONTROLLED -- in its place Column 1,
Line 1, delete "LED" "CONTROL LED" and insert -- CONTROLLED -- in its place Signed and Sealed this Nineteenth Day of November, 2002

*Attest:*

*Attesting Officer*

JAMES E. ROGAN
*Director of the United States Patent and Trademark Office*